US008122896B2

(12) United States Patent
Obermann

(10) Patent No.: US 8,122,896 B2
(45) Date of Patent: Feb. 28, 2012

(54) HAIR-STRAIGHTENING DEVICE

(75) Inventor: Wolfgang Obermann, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 229 days.

(21) Appl. No.: 12/515,017

(22) PCT Filed: Nov. 16, 2007

(86) PCT No.: PCT/IB2007/054682

§ 371 (c)(1),
(2), (4) Date: May 15, 2009

(87) PCT Pub. No.: WO2008/062357

PCT Pub. Date: May 29, 2008

(65) Prior Publication Data

US 2010/0024837 A1 Feb. 4, 2010

(30) Foreign Application Priority Data

Nov. 21, 2006 (EP) ..... 06124438

(51) Int. Cl.
*A45D 20/08* (2006.01)

(52) U.S. Cl. ..... 132/271; 132/901; 132/151

(58) Field of Classification Search ..... 132/223–225, 132/270–272; 34/96–99, 101, 283; 285/261; 239/443, 562; 119/606, 611–615; 15/316.1, 15/344, 400, 402, 405, 418, 422
See application file for complete search history.

(56) References Cited

U.S. PATENT DOCUMENTS

| | | | | | |
|---|---|---|---|---|---|
| 3,696,818 | A | * | 10/1972 | Weber | 132/118 |
| 3,730,190 | A | | 5/1973 | Ford | |
| 3,797,752 | A | | 3/1974 | Cercone | |
| 3,939,850 | A | * | 2/1976 | Wahl | 132/148 |
| 3,965,525 | A | * | 6/1976 | Brissette et al. | 15/373 |
| 4,143,441 | A | * | 3/1979 | Brooks et al. | 15/369 |
| 4,538,362 | A | * | 9/1985 | Andis | 34/97 |
| 4,721,121 | A | * | 1/1988 | Adams | 132/212 |
| 4,827,105 | A | * | 5/1989 | Brown, Jr. | 392/385 |
| 4,955,145 | A | * | 9/1990 | Scivoletto | 132/271 |
| 5,157,757 | A | * | 10/1992 | McDougall | 392/383 |
| 5,394,620 | A | * | 3/1995 | Chimera | 34/97 |
| 5,488,783 | A | * | 2/1996 | Parkinson et al. | 34/98 |
| 5,553,632 | A | * | 9/1996 | Burkhardt | 132/271 |
| 5,621,980 | A | * | 4/1997 | Kingsbury | 34/97 |
| 5,729,907 | A | * | 3/1998 | Santhouse et al. | 34/98 |
| 5,765,292 | A | * | 6/1998 | Chan | 34/98 |
| 5,966,833 | A | * | 10/1999 | Andis et al. | 34/97 |
| 6,009,883 | A | * | 1/2000 | Morrow | 132/211 |
| 6,038,782 | A | * | 3/2000 | Schepisi | 34/97 |

(Continued)

FOREIGN PATENT DOCUMENTS

FR 2785159 A1 5/2000

(Continued)

*Primary Examiner* — Todd Manahan
*Assistant Examiner* — Tatiana Nobrega

(57) ABSTRACT

The invention relates to a hair-straightening device (10) comprising: an air inlet portion (12) for receiving an air stream having a first direction (14), a brush or comb (16) having a plurality of tines (18) and intended to be moved in a moving direction (20), and means (22, 24) for redirecting the air stream into a second direction (26), wherein the angle (α) enclosed by the moving direction (20) and the second direction (26) is smaller than 50 degrees, preferably smaller than 30 degrees, and most preferably smaller than 20 degrees.

10 Claims, 7 Drawing Sheets

U.S. PATENT DOCUMENTS

| | | | | |
|---|---|---|---|---|
| 6,279,234 | B1 * | 8/2001 | Chaouachi et al. | 30/201 |
| 6,922,909 | B2 * | 8/2005 | Andrew et al. | 34/96 |
| 6,966,125 | B2 * | 11/2005 | Rago et al. | 34/283 |
| 7,040,037 | B2 * | 5/2006 | Keong | 34/97 |
| 7,152,610 | B2 * | 12/2006 | Csavas | 132/271 |
| 2003/0037793 | A1 * | 2/2003 | Hwang | 132/118 |
| 2005/0229423 | A1 * | 10/2005 | Keong | 34/96 |
| 2007/0000514 | A1 * | 1/2007 | O'Shaughnessey et al. | 132/321 |
| 2007/0186435 | A1 * | 8/2007 | Fan | 34/96 |
| 2007/0246579 | A1 * | 10/2007 | Blateri | 239/599 |

FOREIGN PATENT DOCUMENTS

| | | | |
|---|---|---|---|
| WO | 2005123352 | A2 | 12/2005 |

* cited by examiner

HAIR-STRAIGHTENING DEVICE

FIELD OF THE INVENTION

The invention relates to a hair-straightening device.

BACKGROUND OF THE INVENTION

The classic way to straighten hair is to use a hairdryer and a brush. However, this procedure can take a long time. Alternatively, it is known to use a so-called straightening iron. Such straightening irons are preferably applied to more or less dry hair, i.e. after drying of the hair with, for example, a hairdryer. Since the straightening irons operate at high temperatures and in direct contact with the hair to be straightened, there is a dehumidifying effect that can lead to brittle hair.

The term hair-straightening as used herein is intended to encompass all actions that lead to a certain hair-straightening effect, even if the hair does not become perfectly straight as is possibly the case, for example, with straightening irons.

It is an object of the invention to provide a hair-straightening device which is easy and fast to use and which at least reduces the dehumidifying effect in comparison with straightening irons.

SUMMARY OF THE INVENTION

The above object is achieved by a hair-straightening device comprising: an air inlet portion for receiving an air stream having a first direction, a brush or comb having a plurality of tines and intended to be moved in a moving direction, and means for redirecting the air stream into a second direction, wherein the angle enclosed by the moving direction and the second direction is smaller than 50 degrees, preferably smaller than 30 degrees, and most preferably smaller than 20 degrees. The hair-straightening device in accordance with the invention may, for example, be attached to a conventional hairdryer and/or hairstyler capable of generating the air stream. Hair-drying and hair-straightening are preferably performed simultaneously. In accordance with the invention, the entire air stream is preferably redirected into the second direction. Apart from some turbulences or swirls which cannot be avoided at least in some cases, essentially the entire air stream is thus redirected into the direction towards the hair tips. Ideally, the moving direction, the second direction, and the direction towards the hair tips are parallel.

It is preferred that at least some of the tines are formed by a plurality of parallel blades. In such a case, the parallel blades facilitate the redirecting of the air stream into the second direction, and a uniform redirected air stream can be created.

The means for redirecting the air stream may comprise at least one air baffle arranged essentially perpendicularly, at least in portions, to at least some of the blades. With such a configuration pressure losses can be minimized.

It is regarded as advantageous that the baffle is curved at least in portions. Turbulences or swirls created during the air redirection process can be minimized thereby as compared, for example, with solutions where the baffle comprises one or more kinks.

In highly preferred embodiments, the brush or comb is moveable with respect to the air inlet portion. The brush or comb can thus be optimally aligned when moved in contact with the scalp. This effect can be enhanced if the geometry of the portions of the blades forming the tines is adapted to the geometry of a human head, i.e. if these portions are not straight but slightly curved.

It is further preferred in this connection that the brush or comb is pivotable about an axis perpendicular to the moving direction. It is, for example, possible that the axis extends perpendicularly through the blades that form the brush or comb.

In accordance with a further improvement, the brush or comb is spring-biased with respect to the inlet portion. This renders it possible for the brush or comb to follow the contour of the head as long as it is in contact therewith, and that the brush or comb assumes a defined position with respect to the inlet portion (and, for example, the handle of the hairdryer) when not in direct contact with the head.

Preferably, the inlet portion comprises coupling means for coupling the straightening device to a hairdryer and/or hairstyler. The hairdryer or hairstyler may comprise corresponding coupling mean at least in some cases, for example in the air outlet region. The coupling means may provide a frictional or a matching-shape closure. For example, it is possible to use snap-in or interlocking coupling elements. It is also possible to provide the hair-straightening device in accordance with the invention with universal adapter means enabling an attachment to usual hairdryers and/or hairstylers.

These and other aspects of the invention will be apparent from and elucidated with reference to the embodiments described hereinafter.

DESCRIPTION OF THE PREFERRED EMBODIMENTS

Figure 1:
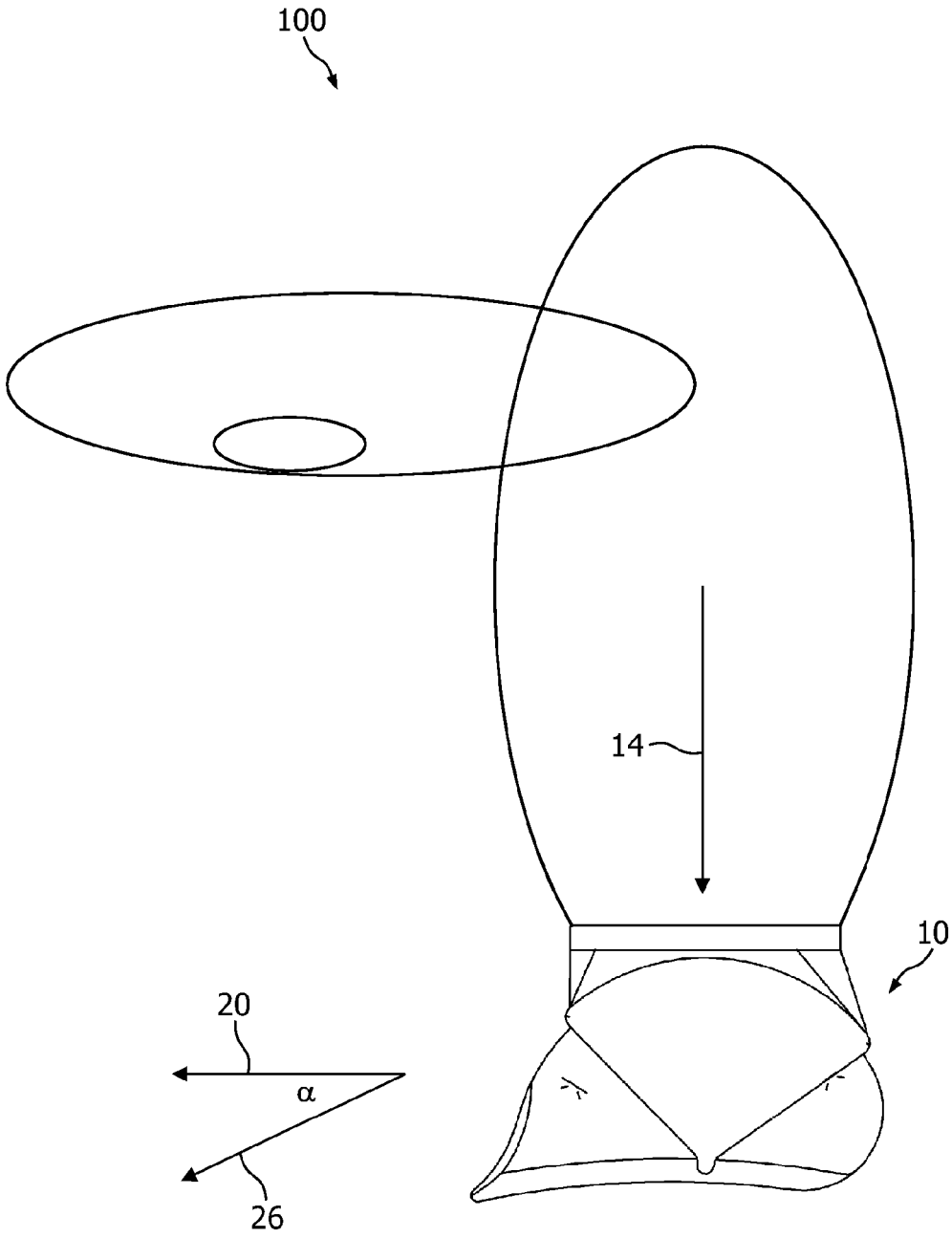
FIG. 1 shows an embodiment of the hair-straightening device in accordance with the invention attached to a hairdryer.
Figure 2:
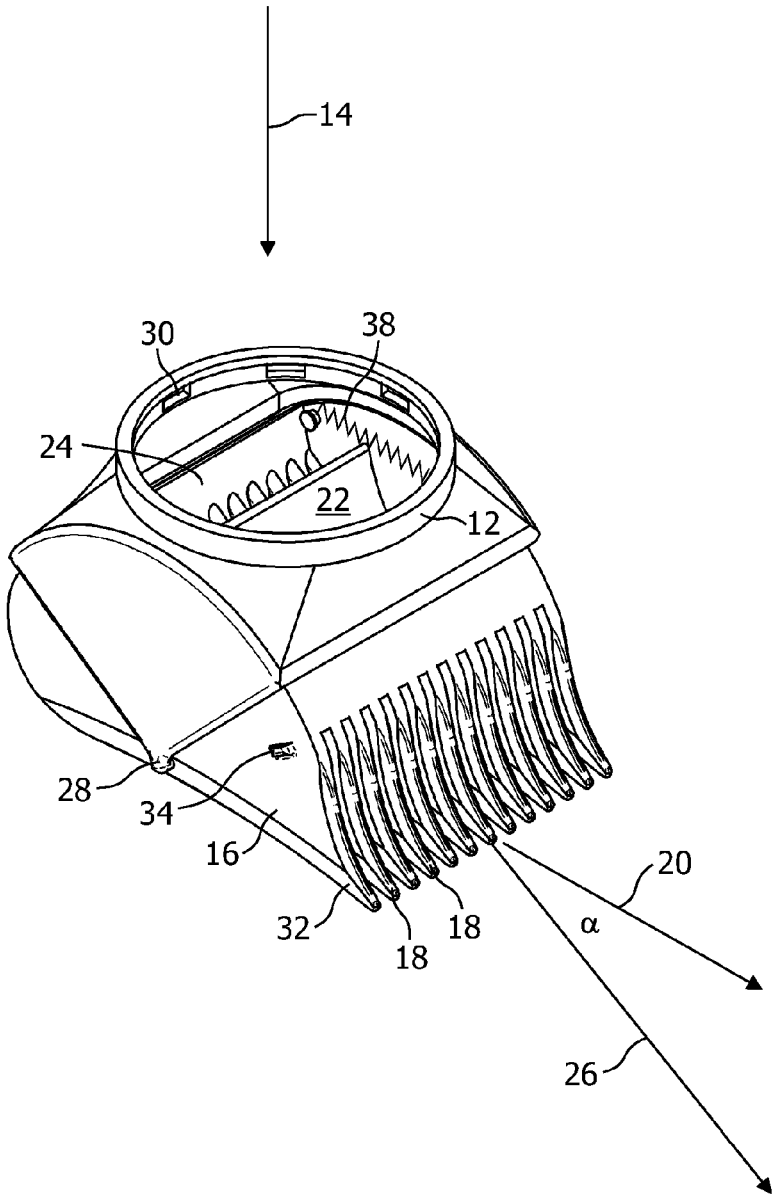
FIG. 2 is a perspective view of the hair-straightening device of FIG. 1 detached from the hairdryer.
Figure 3A:
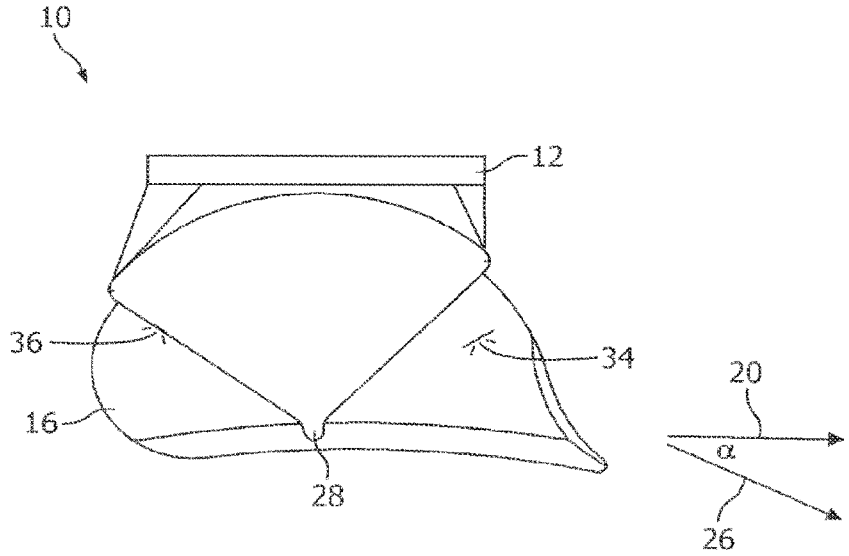
FIG. 3A shows a moveable brush or comb in its resting position.
Figure 3B:
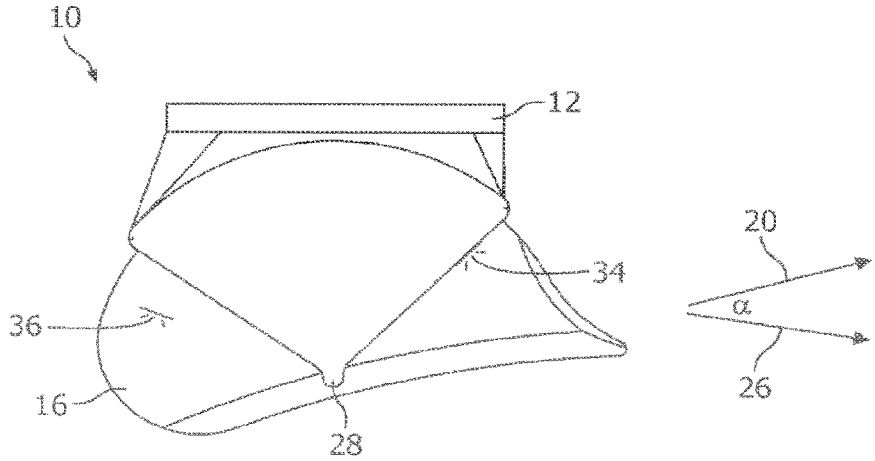
FIG. 3B shows the brush or comb in a pivoted position.
Figure 4:
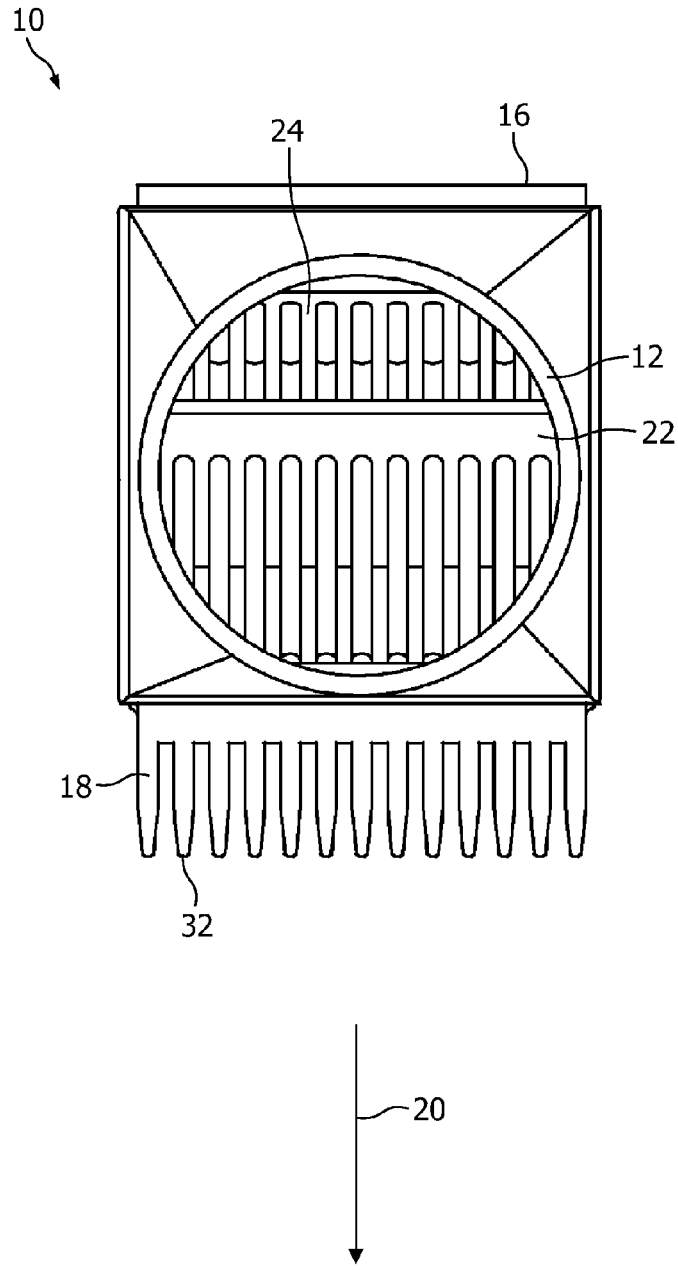
FIG. 4 is a plan view of the hair-straightening device of FIG. 1.
Figure 5:
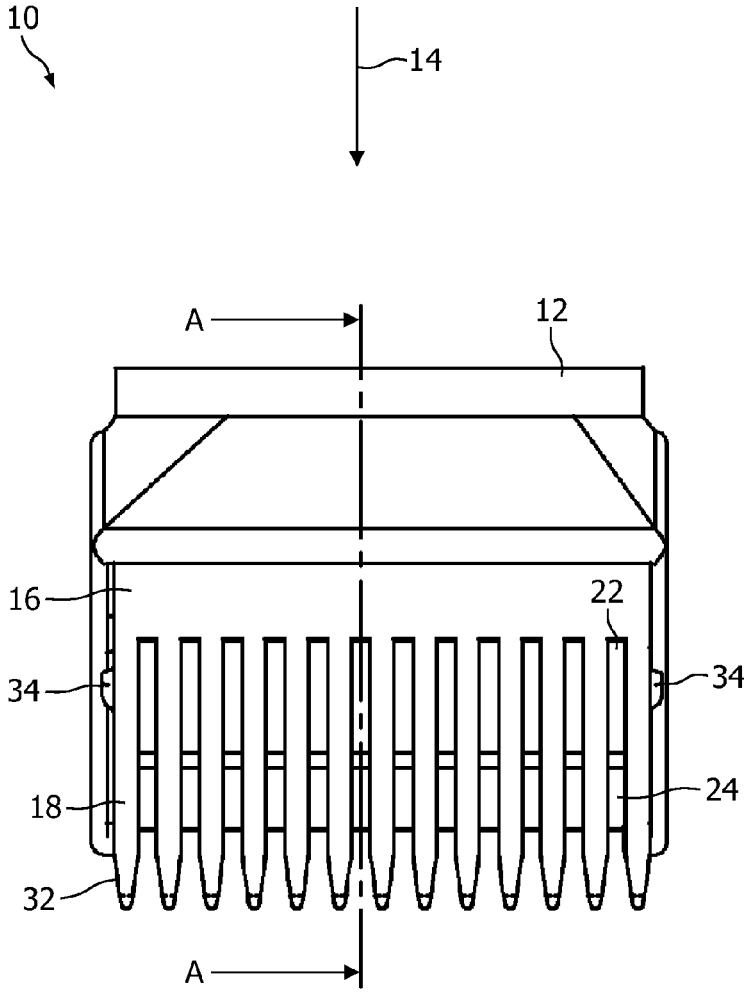
FIG. 5 is a front elevation of the hair-straightening device of FIG. 1.

Equal reference numerals in the following description denote equal parts, which parts are described only once at least in some cases to avoid repetitions.

FIG. 1 shows an embodiment of the hair-straightening device 10 in accordance with the invention attached to a hairdryer 100 in the air outlet portion thereof. The air stream leaves the hairdryer 100 and enters the hair-straightening device 10 in a first direction 14. By moving the hairdryer 100 one can move the hair-straightening device 10 in a preferred moving direction 20. Within the hair-straightening device 10 there are provided means (not visible in FIG. 1) for redirecting the air stream into a second direction 20. The angle $\alpha$ enclosed by the moving direction 20 and the second direction 26 of the redirected air stream is smaller than 50 degrees, preferably smaller than 30 degrees, and most preferably smaller than 20 degrees. The second direction 26 of the redirected air stream is thus directed towards the hair tips, and this provides the hair-straightening effect.

Reference is now made to FIGS. 2 to 6, to describe the hair-straightening device 10 in greater detail. The hair-straightening device 10 comprises an inlet portion 12 and a comb 16. The comb 16 comprises a plurality of tines 18 formed by parallel blades having tapered end portions 32. The comb 16 and the inlet portion 12 are moveable with respect to each other, since the comb is pivotable about an axis 28 perpendicular to the moving direction 20. The possible movement of the comb 16 with respect to the inlet portion 12 is restricted by abutments 34 and 36 (see particularly FIGS. 3A and 3B showing two side elevations of the hair-straightening device 10, wherein the upper part of FIG. 3A shows the moveable comb 16 in its resting position and the lower part of FIG. 3B shows the comb 16 in a pivoted position). The comb 16 is spring-biased with respect to the inlet portion 12 by means of at least one spring 38 (shown in FIG. 2). The inlet portion 12 comprises coupling means 30 for attaching the hair-straightening device 10 to a hairdryer comprising corresponding coupling means in its air outlet region. The coupling means may be formed, for example, by recesses 30 provided in the inlet portion 12 and intended to interact with snap-in tongues provided in the air outlet region of the hairdryer. As may be best seen in FIG. 6, the means for redirecting the air stream into the second direction 26 are formed by two baffles 22, 24 in the illustrated case. These baffles 22, 24 are curved, with the upper portions thereof extending essentially perpendicularly to the moving direction 20.

Figure 6:
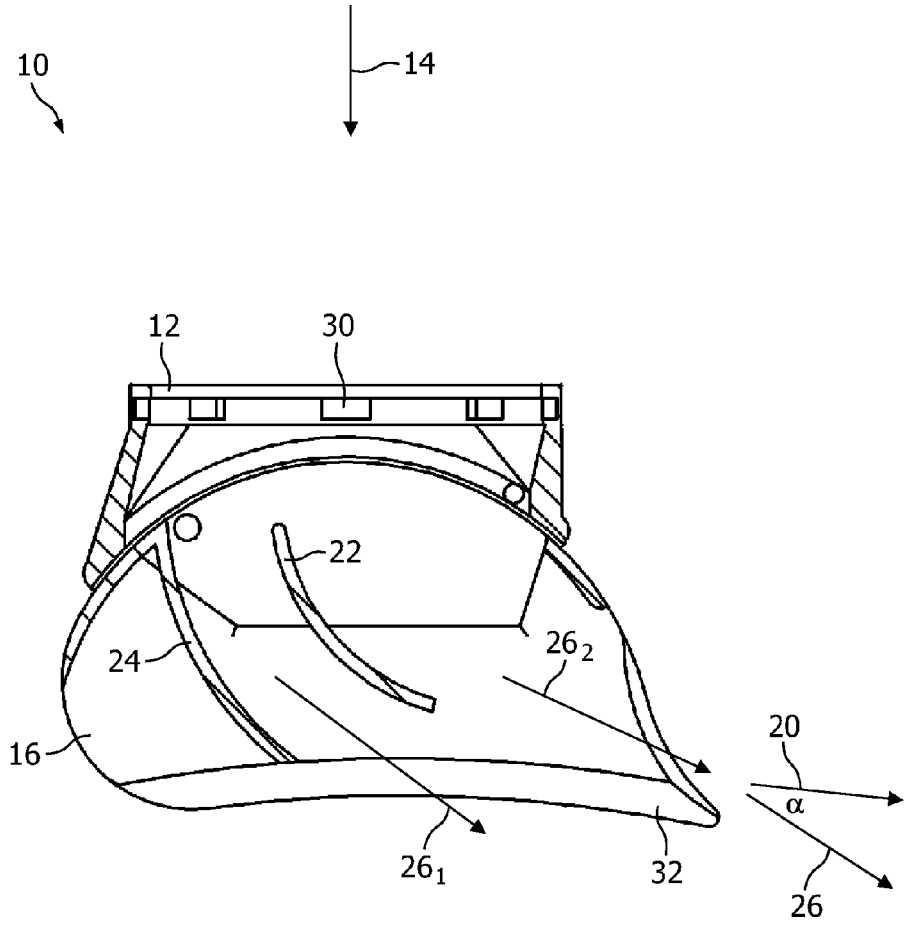
FIG. 6 is a sectional side view of the hair-straightening device of FIG. 1 taken on the intersection line A-A shown in FIG. 5.
Figure 7:
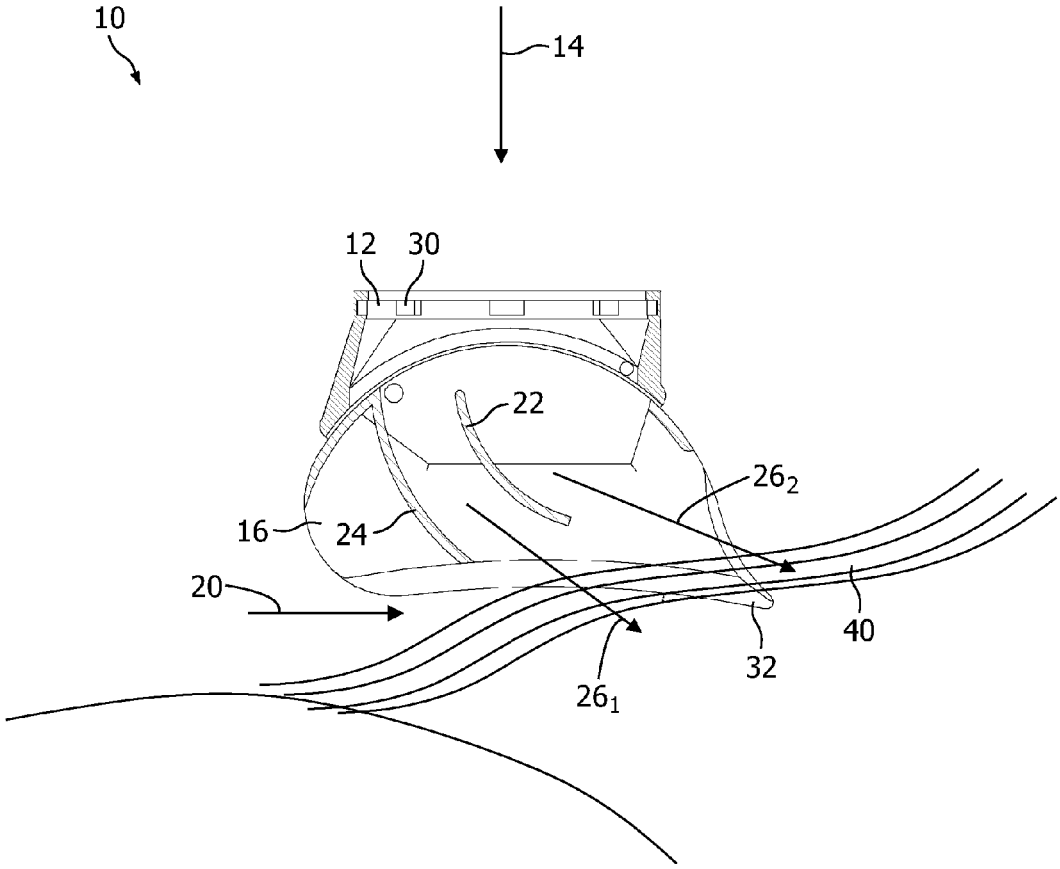
FIG. 7 is a sectional side view corresponding to that of FIG. 6 and schematically illustrating the operation of the hair-straightening device in accordance with the invention, wherein only the hair-straightening device 10 is shown and the hairdryer is omitted for the sake of simplicity.

FIG. 7 is a sectional side view corresponding to that of FIG. 6 and schematically illustrating the operation of the hair-straightening device 10 in accordance with the invention, wherein only the hair-straightening device 10 is shown and the hairdryer is omitted for simplicity's sake. As may be seen, the second direction 26 of the redirected air stream is essentially towards the tips of hair 40 to be straightened. In the illustrated case the air stream component redirected by the front baffle 22 encloses a slightly smaller angle with the moving direction 20 than the air stream component redirected by the rear baffle 24. In the illustrated case, this is due to the different curvatures of the baffles 22, 24. If the individual air stream components from the front and rear baffles 22, 24 respectively comprise (slightly) different directions $\mathbf{26}_1$, $\mathbf{26}_2$, then, as regards the definitions outlined in the claims, the vector sum of these directions $\mathbf{26}_1$, $\mathbf{26}_2$ shall be regarded as the common direction 26 of the redirected air stream.

Finally, it is to be noted that equivalents and modifications not described above may also be employed without departing from the scope of the invention, which is defined in the accompanying claims.

The invention claimed is:

1. A hair-straightening device comprising:

an air inlet portion for receiving an input air stream having a first direction;

a brush or comb having a plurality of tines arranged in a row, along an axis and intended to be moved in a moving direction substantially perpendicular to said axis; and means for redirecting the input air stream having the first direction into an output air stream having a second direction, wherein an angle ($\alpha$) enclosed by the moving direction and the second direction is smaller than 50 degrees.

2. The hair-straightening device as claimed in claim 1, wherein at least some of the tines are formed by a plurality of parallel blades.

3. The hair-straightening device as claimed in claim 2, wherein the means for redirecting the air stream comprises at least one air baffle arranged essentially perpendicularly, at least in portions, to at least some of said plurality of parallel blades.

4. The hair-straightening device as claimed in claim 3, wherein the baffle is curved at least in portions.

5. The hair-straightening device as claimed in claim 1, wherein the brush or comb is moveable with respect to the air inlet portion.

6. The hair-straightening device as claimed in claim 5, wherein the brush or comb as a whole is pivotable about an axis perpendicular to the moving direction.

7. The hair-straightening device as claimed in claim 5, wherein the brush or comb as a whole is spring-biased with respect to the air inlet portion.

8. The hair-straightening device as claimed in claim 1, wherein the air inlet portion comprises coupling means for coupling the straightening device to a hairdryer and/or a hairstyler.

9. A hair dryer comprising the hair-straightening device as claimed in claim 8.

10. A hairstyler comprising a hair-straightening device as claimed in claim 8.

* * * * *